United States Patent [19]

Whitsett

[11] 3,948,005

[45] Apr. 6, 1976

[54] CEILING GRINDING APPARATUS

[76] Inventor: Jack W. Whitsett, 936 Castile Ave., Coral Gables, Fla. 33134

[22] Filed: Jan. 3, 1975

[21] Appl. No.: 538,333

[52] U.S. Cl. ..... 51/180

[51] Int. Cl.[2] ..... B24B 23/00

[58] Field of Search ..... 51/170 R, 170 T, 180; 15/49 R, 50 R, 98, 385

[56] References Cited

UNITED STATES PATENTS

| | | | |
|---|---|---|---|
| 1,728,487 | 9/1929 | Gardner | 51/180 |
| 2,670,577 | 3/1954 | McDonough | 51/180 |
| 2,755,606 | 7/1956 | Ronvold et al. | 51/180 |
| 3,268,935 | 8/1966 | Ungeheuer | 15/21 R |
| 3,522,679 | 8/1970 | Sundberg | 51/177 X |

FOREIGN PATENTS OR APPLICATIONS

| | | | |
|---|---|---|---|
| 1,195,454 | 5/1959 | France | 51/180 |

*Primary Examiner*—James L. Jones, Jr.
*Attorney, Agent, or Firm*—Roylance, Abrams, Berdo & Kaul

[57] ABSTRACT

A ceiling grinding apparatus for use in surfacing concrete ceilings comprising a portable support assembly having independently suspended wheels; a central member vertically movable along the support assembly; a boom pivotally mounted on the central member; a grinding assembly coupled to one end of the boom including blade means rotatably supported in a housing; and a biasing mechanism for forcing the blade means against the ceiling during the grinding operation. An exhaust system is connected to the housing for removing the dust and concrete chips therefrom and transferring this material to a collection bag. A hydraulic motor is used to rotate the blade means and is driven by a hydraulic pump coupled to an electrical motor, with the hydraulic fluid being stored in the central member.

8 Claims, 8 Drawing Figures

CEILING GRINDING APPARATUS

The present invention relates to abrading or grinding machines, and more particularly, it relates to a ceiling grinding apparatus for use in surfacing concrete ceilings.

Concrete has now become a very popular material used in the construction of buildings, mainly because of its strength and durability and because molding and casting technology has advanced greatly in recent years. However, in most cases after a concrete structure, such as a ceiling has been cast and the mold removed therefrom, the surface of the concrete ceiling is rough due to inconsistencies in the surface of the molds and indentations formed by the seams between adjacent molds. Thus, it is necessary to dress or smooth poured concrete ceilings by grinding the exposed surfaces of the ceiling.

Although there have been ceiling grinding machines known in the prior art, these machines have heretofor been unsatisfactory in various manners. First, typically these grinding machines utilize abrading discs, cups or belts which wear out quickly, necessitating expensive and time consuming replacement, and do not provide a very strong abrading force to the concrete. Additionally, these ceiling grinding machines typically drive the abrading device by means of a flexible cable coupled to an electrical motor. However, this flexible cable is subject to intense frictional forces and therefore wears out quickly. Moreover, the use of single phase electrical motors to run such abrading devices restricts the device to one rotational speed, thereby reducing the versatility of the device.

Another problem with prior art machines is their poor maneuverability. In most buildings under construction, both plumbing stubs and electrical conduit stubs protrude from the floor approximately 8 to 18 inches above the floor's surface and the prior art grinders have transverse axles and low horizontal framing which are well below the average height of the plumbing and electrical conduit stubs. This obviously causes interference and makes it difficult to maneuver the machine while trying to grind the ceiling above the floor.

A further problem is controlling the apparatus during the grinding operation. In the prior art devices, the grinding mechanism must be manually manipulated against the ceiling by the operator while the operator moves the entire apparatus over the area to be grinded. This distracts the operator from safely traversing the floor upon which the apparatus is guided and also forces the operator to stand quite close to the grinding assembly, increasing the chance of injury to the operator from flying concrete chips.

Finally, attendant to the grinding operation of a concrete ceiling is the flying dust and concrete chips abraded from the concrete material. Certain prior art devices have attempted to provide various means for conducting these materials into a container; however, they have been routinely unsatisfactory.

To overcome these problems, the ceiling grinding apparatus in accordance with the present invention includes abrading blades, thereby providing a strong, durable abrading action; a hydraulic motor for powering the abrading blades, thereby providing variable speed, and an inherent lubrication to the rotating drive shaft; independently suspended wheels and castors, thereby providing increased maneuverability; an automatically biased grinding assembly forcing the grinding blades against the ceiling, thereby allowing the operator to concentrate on guiding the apparatus; and an efficient exhaust system, thereby providing a reliable collection system for dust and chips created by the grinding operation.

It is therefore an object of the present invention to provide a ceiling grinding apparatus capable of efficiently surfacing the rough surface of ceilings formed of concrete.

Another object of the present invention is to provide a ceiling grinding apparatus which is both sturdy and durable and easy to control.

Another object of the present invention is to provide a ceiling grinding apparatus which is highly maneuverable, safe to operate and collects the waste products from the grinding operation.

A further object of the present invention is to provide a ceiling grinding apparatus having a variable speed abrading assembly powered by a hydraulic motor.

The foregoing objects are attained by providing an apparatus which is comprised of a portable support assembly; a central elongated member coupled to the support assembly for vertical movement; a boom assembly pivotally mounted on the top of the central member; a grinding assembly coupled to a first end of the boom assembly, the grinding assembly including blade means for grinding the ceiling and rotation means for rotating the blade means; biasing means for biasing the second end of the boom assembly downwards and the first end upwards to force the blade means against the ceiling; and elevating means carried on the support assembly for moving the central member vertically upward and downward.

Other objects, advantages and salient features of the present invention will become apparent from the following detailed description, which, taken in conjunction with the annexed drawings, discloses a preferred embodiment of the present invention.

Referring now to the drawings which form a part of this original disclosure:

Figure 1:
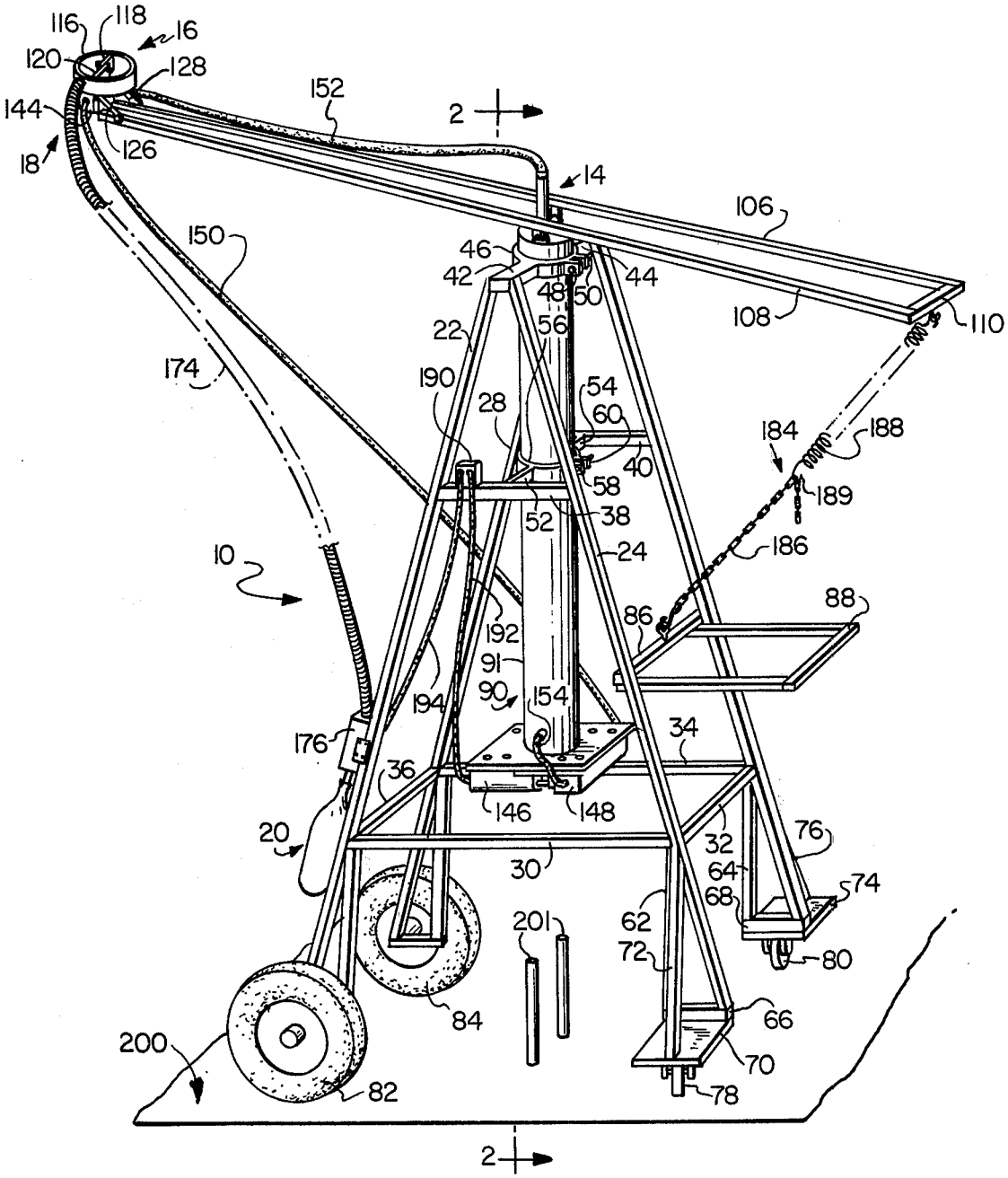
FIG. 1 is a perspective view of a ceiling grinding apparatus in accordance with the present invention.
Figure 2:
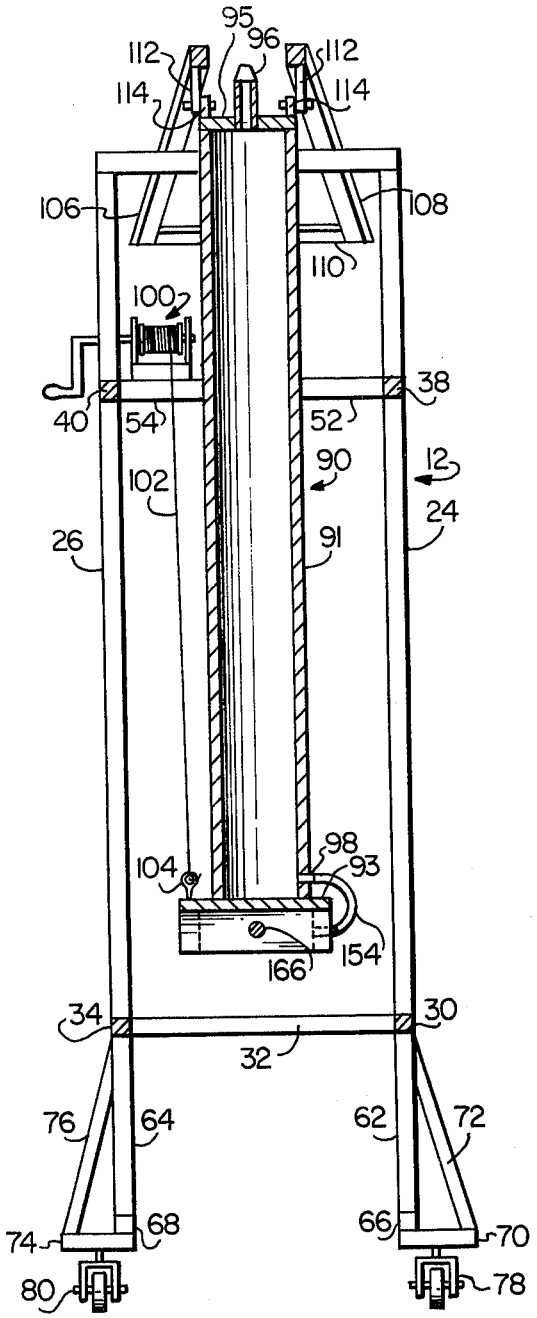
FIG. 2 is a vertical sectional view of the apparatus shown in FIG. 1 taken along lines 2—2 in FIG. 1.

Referring now to the drawings in further detail, as seen in FIGS. 1 and 2, the ceiling grinding apparatus 10 is comprised of a support assembly 12, a boom assembly 14, a grinding assembly 16, an exhaust system 18 and a collecting container 20, as well as a central elongated member 90 and a biasing mechanism 184.

The support assembly 12 is comprised of four structural members 22, 24, 26, and 28, four struts 30, 32, 34, and 36, and two bars 38 and 40.

Each structural member is an elongated steel bar having a rectangular cross section. Structural members 24 and 26 are in a parallel, spaced-apart relationship and are oriented at approximately a 70° angle to the horizontal plane containing floor 200. Structural members 22 and 28 are similarly in a parallel, spaced-apart position and are oriented at an angle of approximately 110° to the horizontal plane, thereby forming an angle of approximately 40° between structural members 22 and 24, which are in the same vertical plane, and a similar angle between structural members 26 and 28, which are also in the same vertical plane. Structural members 22 and 24 are welded at their tops to a horizontally oriented bar 42 and structural members 26 and 28 are similarly welded to a horizontally oriented bar 44.

Welded to the distal ends of bars 42 and 44 is a split ring 46 formed as a C-clamp having a bolt 48 and nut 50 closing the clamp by passing through suitable apertures therein.

Struts 30 and 34 are horizontally oriented and are connected at their ends, respectively, between structural members 22 and 24, and 26 and 28, at a height approximately equal to one-third the height of the structural members. Similarly, struts 32 and 36 are horizontally oriented and are connected, respectively, at their ends between structural members 24 and 26, and 22 and 28 in the same horizontal plane as members 30 and 34. Bars 38 and 40 interconnect, respectively, members 24 and 22, and 26 and 28, are horizontally oriented and are located at a height approximately equal to two-thirds the height of the structural members.

Extending inwardly in a horizontal direction from bars 38 and 40 are two bars 52 and 54 which are connected by means of a split ring 56 formed as a C-clamp being closed by a bolt 58 and a nut 60.

Extending vertically downward from locations adjacent the intersection of struts 30 and 34 with structural members 24 and 26, respectively, are two rods 62 and 64 which are interconnected, respectively, to the bottoms of structural members 24 and 26 by means of horizontally oriented bars 66 and 68.

A plate 70 is welded to the bottom of bar 66, extends outwardly in a horizontal direction and is supported by means of an angle iron 72 welded to the plate's top surface and to a side of structural member 24 in a position just below strut 30.

A similar plate and angle iron construction is connected to structural member 26 including a plate 74 and an angle iron 76.

Rotatably coupled to the bottom of plate 70 is a castor 78 and rotatably coupled to the bottom of plate 74 is a second caster 80.

Rotatably mounted along a horizontal axis to the bottom of structural member 22 is a wheel 82 and rotatably mounted to the bottom of structural member 28 is another wheel 84.

Interconnecting structural members 24 and 26, in a position between bars 38 and 40 and struts 30 and 34, is a rod 86 having a U-shaped handle 88 extending outwardly therefrom.

As shown in FIG. 2, a vertically oriented reservoir, or central elongated member, 90 containing hydraulic fluid 93 therein is formed of a cylindrical tube 91, such tube being supported in rings 46 and 56 as seen in FIG. 1. The bottom of tube 91 is closed by means of a horizontally oriented rectangular plate 93 and the top of the tube is closed by means of a horizontally oriented circular plate 95 having an outlet tube 96 passing through a suitable aperture therein. Just above the bottom plate 93 is another outlet tube 98 passing through the wall of tube 91.

An elevating assembly for tube 91 is in the form of a winch 100 which is suitably supported on the top of bar 54 and has a cable 102 extending downwardly therefrom and connected to the plate 93 via an eye bolt 104 connected to the top surface thereof.

The boom assembly 14, as seen in FIG. 1, is formed from two elongated bars or members 106 and 108 which are pivotally connected to the top plate 95 on the tube 91 and are connected to each other at a first end directly by a weld and at a second end by a short bar 110 welded between the ends thereof. The pivotal connection with the plate 95 is accomplished by means of two downwardly extending plates 112, one connected at substantially the mid-portion of each member 106 and 108 and connected to an upstanding plate 114 on the side edges of plate 95 by means of bolts passing through suitable apertures in the plates 112 and 114.

At the first end of the boom assembly members 106 and 108 is a housing 116 which partially surrounds abrading blades 118 and 120.

The housing 116 is a cylindrical tube having one closed end 122 which receives an open tube 124 in a central bore therein. The housing has an inner diameter which is greater than the length of each blade and an axial length greater than the thickness of each blade. When the shaft 132 is rotated, the blades are oriented in a position shown in FIG. 3 with the plane containing edges 119 being slightly above the plane containing the open end of housing 116. This orientation of the blade edges is caused by the centrifugal force of rotation applied to the blades. When not rotating, the blades pivot around the axis of bolt 140 due to gravitational forces and assume an orientation such that each edge forms an acute angle with the plane containing the open end of housing 116.

Figure 4:
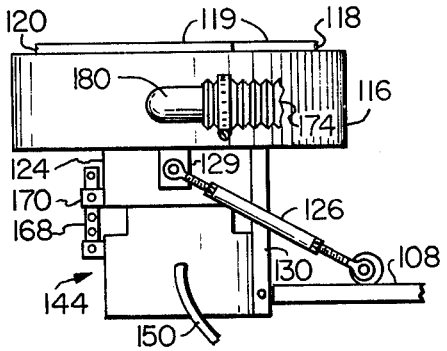
FIG. 4 is a side elevation of the grinding assembly and the housing surrounding the blades, as well as part of the boom assembly and the hydraulic motor.

As best seen in FIGS. 1 and 4, the housing 116 is connected to the ends of boom assembly members 106 and 108 by means of rods 126 and 128 which are both pivotally connected to the boom members at one end and plates 129 depending from the housing 116 at the other end. Additionally, a rod suitably bolted to the ends of members 106 and 108 is welded on the outside surface and axially of the open tube 124 and the closed end 122 of the housing 116.

The grinding assembly 16 consists of abrading blades 118 and 120, shaft 132, and a rotation mechanism for rotating the shaft 132.

Figure 5:
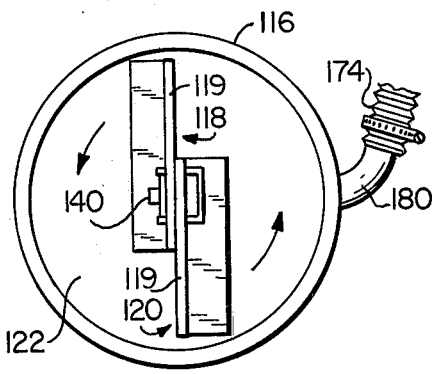
FIG. 5 is a top plan view of the abrading blades and the housing.
Figure 6:
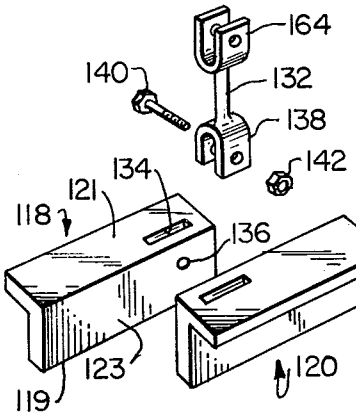
FIG. 6 is an exploded perspective of the abrading blades and the shaft to be connected thereto.

As shown in FIG. 6, each blade is formed of two short bars 121 and 123 coupled at a right angle. Adjacent one end of bar 121 is a slot 134 oriented parallel to the longitudinal axis of the bar. On bar 123, adjacent slot 134, is a transverse bore 136. Each blade has an abrading edge 119 on the distal edge of bar 123. The shaft 132 has a clevis 138 at one end, the legs of which pass through the slots in the blades where a bolt 140 passes through the bores 136 and the apertures in the clevis 138 and is secured by a nut 142. This is most clearly shown in FIG. 5. By means of this connection the blades 118 and 120 can pivot around the bolt 140 which has an axis perpendicular to the longitudinal axis of the shaft 132 which is coincident with the axis of rotation of that shaft, as will be described hereinafter. A second clevis 164 is formed at the other end of the shaft 132.

As shown in FIGS. 1, 3, 4, and 7, the rotation mechanism for rotating the shaft 132 comprises a hydraulic motor 144, an electrical motor 146, a hydraulic pump 148, a first conduit 150, a second conduit 152 and a third conduit 154.

Figure 3:
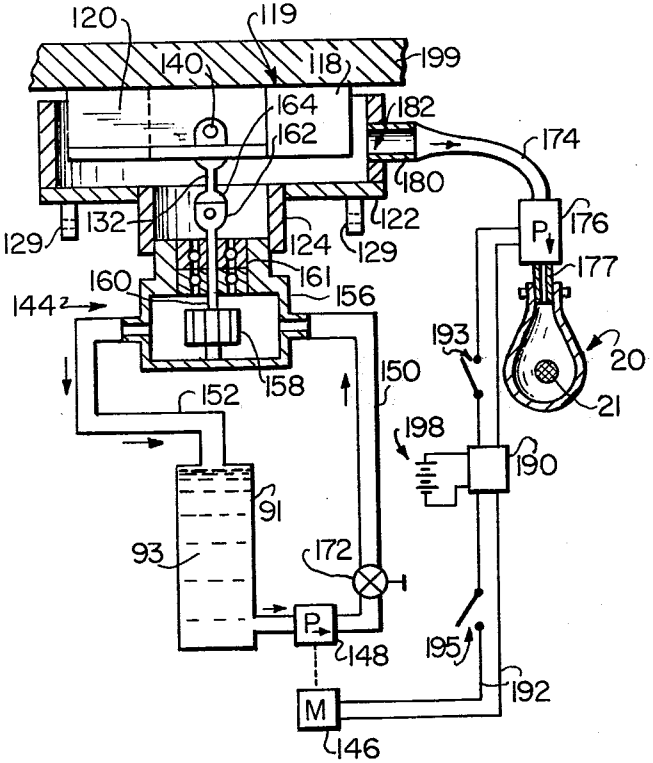
FIG. 3 is a sectional view of the grinding and exhaust assemblies of the apparatus of FIGS. 1 and 2 with a schematic diagram of hydraulic and electric control apparatus therefor.

As seen in FIG. 3, the hydraulic motor 144 is conventional and has a housing 156 which fits into the bottom open end of the open tube 124 and carries a rotor 158. The rotor 158 is connected to a shaft 160 which is supported on bearings 161 and is bolted via a clevis 162 to the second clevis 164 on the end of the blades' shaft 132.

Figure 7:
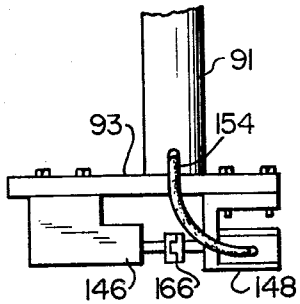
FIG. 7 is a side elevation of the electrical motor, the hydraulic pump, and a part of the reservoir for the hydraulic fluid.

The electrical motor 146 is bolted to the bottom of plate 93, as shown in FIG. 7, and has a removable coupling 166 to the hydraulic pump 148 which is also bolted to the bottom of plate 93.

Referring to FIG. 3, the first conduit 150, which, like the other conduits, can be a rubber tube with suitable coupling devices at its ends, interconnects the hydraulic pump 148 with the hydraulic motor 144. The second conduit 152 interconnects the hydraulic motor 144 and the reservoir 90, the connection to the reservoir being made via outlet tube 96 in the top of the reservoir, as shown in FIG. 2. The third conduit 154 interconnects the reservoir 90 with the hydraulic pump 148, such conduit being connected to the outlet tube 98 at the bottom of the reservoir 90, as shown in FIG. 2.

Referring back to FIG. 4, an adjustable connection between the hydraulic motor 144 and the tube 124 of the housing 116 is accomplished by means of a rod 168 bolted to one side of the hydraulic motor and bolted at any one of a plurality of apertures therein to a plate 170 which is mounted to the outside of the open tube 124. Thus, the hydraulic motor 144 may be adjusted longitudinally along the inside of tube 124 with a concomitant adjustment of the relationship of the blades 118 and 120 and the housing 116 as will be described in more detail hereinafter. As seen in FIG. 3, an adjustable valve 172 is located in the first conduit 150 to vary the flow of hydraulic fluid to the hydraulic motor 144, thereby providing a variable rotational speed to the motor's rotor 158 and the blades 118 and 120 connected thereto via the shaft 132.

As shown in FIGS. 1 and 3, the exhaust system 18 comprises the housing 116, a conduit 174 and a vacuum pump 176. A short tube 180 fits into an aperture 182 in the side wall of the housing 116 and has connected thereto the conduit 174 which is connected at its other end to the vacuum pump 176. The vacuum pump in turn has an exhaust directly communicating with the collecting container 20. As shown in FIG. 1, preferably, the vacuum pump 176 is bolted in a suitable fashion to the structural member 22 at a position between bar 38 and strut 30.

The collecting container 20, as seen in FIG. 3, is a conventional vacuum-type paper bag having an aperture with a filter 21 thereover so that air entering the bag may exit therefrom, but larger dust particles and concrete chips carried with the air from the housing 116 into the bag remain therein. Preferably, the bag has an opening which may be fitted over the exhaust pipe 177 of the vacuum pump with the bag being tied or otherwise secured thereto in a substantially air-tight fashion.

Returning to FIG. 1, a biasing mechanism 184 is shown as being formed from a chain 186 and a spring 188. One end of the spring is suitably connected to the bar 110 interconnecting members 106 and 108 at the second end of the boom assembly and is releasably connected by means of a hook 189 at its end along the length of chain 186 which has a second end connected to rod 86. This mechanism biases the boom assembly downwards at this end and forces the grinding assembly end upwards forcing blades 118 and 120 against the ceiling.

Referring to FIGS. 1 and 3 again, an electrical junction box 190 is rigidly supported on bar 38 and has an electrical conductor 192 connected to the electrical motor 146 and a second electrical conductor 194 connected to the electrical vacuum pump 176. Conventional single-pole, single-throw switches 193 and 195 are located along conductors 192 and 194, respectively. The junction box 190 is connected via an extension cord 196 to a suitable electrical power source 198. This being shown in the schematic representation of FIG. 8.

Figure 8:
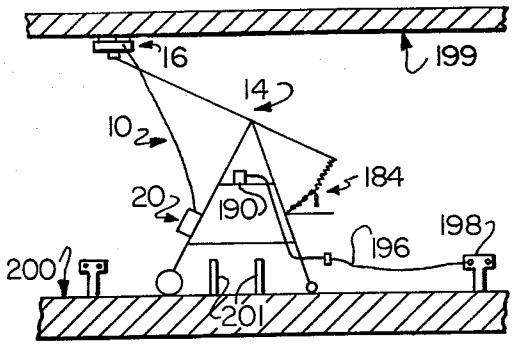
FIG. 8 is a schematic diagram showing the ceiling grinding apparatus in operation.

As shown in FIG. 8, the ceiling to be abraded is designated 199 and the floor upon which the apparatus 10 is supported is designated 200. The plumbing stubs, about which the apparatus must be maneuvered, are generally indicated at 201 and the electrical conduits are designated 198, one of which comprises the electrical power source referred to above.

In operation, the apparatus 10 is maneuvered along the floor 200 to a position below the ceiling 199 which is to be grinded. If necessary, new blades 118 and 120 are connected to the grinding assembly 16 and the abrading edges 119 thereof are brought into a position so that on rotation thereof they will be slightly above the plane containing the open end of the housing 116 by adjusting the relative position of the hydraulic motor 144 relative to the open tube 124 via rod 168. After these blades have been used for awhile and their edges worn down slightly, the hydraulic motor can be further adjusted to once again support these edges substantially above the plane containing the open end of the housing on rotation of the blades.

After the blades are adjusted the biasing mechanism 184 is adjusted by means of connecting chain 186 to the hook end of the spring 188 so that the boom assembly 14 is positioned, as seen in FIG. 8, with the open end of the housing 116 and the abrading edtes 119 of the blades substantially flush with the surface of the ceiling 199. The hook 189 is coupled to the chain 186 along the chain's length to provide the desired biasing force to the grinding assembly. Depending on the desired rotational speed of the blades, the adjustable valve 172 is manipulated so as to allow the desired amount of hydraulic fluid to enter the hydraulic motor 144.

The extension cord 196 is connected to the electrical power source 198 and switches 193 and 195 are closed, thereby energizing the vacuum pump 176 and the electrical motor 146.

This causes the vacuum pump 176 to cause a draft of air to move from within the housing 116 through the short tube 180, along the conduit 174 through the vacuum pump itself and into the collecting bag 20.

Simultaneously, this energization causes the electrical motor 146 to rotate its shaft, thereby causing the hydraulic pump 148 to pump fluid 93 from the reservoir 90 via the third conduit 154 and then along the first conduit 150 and into the hydraulic motor 144. There the hydraulic fluid strikes the rotor 158 and provides the required rotation thereto. Since the rotor is connected to the shaft 132 supporting the abrading blades 118 and 120, these blades rotate and provide the abrading action to the concrete ceiling 199 which they are contacting. The hydraulic fluid exits the hydraulic motor 144 and returns to the reservoir 90 via conduit 152. The dust and concrete chips resulting from the abrading action move out the housing through aperture 182 and follow the draft of air created by the rotating blades and the vacuum pump 176 down conduit 174 into the collecting container.

The apparatus is now fully under way in its abrading operation and is easily maneuvered by the operator along the floor 200 so as to cover the desired area on the ceiling 199. Since the wheels 82 and 84 and the castors 78 and 80 are on independent axles, the apparatus 10 may be maneuvered easily along the floor having the plumbing stubs 201 and electrical conduits 198 thereon. Since the blades are forced against the ceiling by the biasing mechanism 184, the operator merely guides the apparatus via handle 88 and does not have to be concerned with manipulating the blades.

If the operator of the apparatus 10 believes more pressure of the blades 118 and 120 on the ceiling surface is required, he merely increases the biasing force of spring 188 by connecting the hook end thereof further down along the length of the chain 186 or by raising central member 90.

In certain cases where the ceiling height varies greatly with respect to the floor, bolts 48 and 50 on split rings 46 and 56 are loosened and the winch 100 is operated to raise the central member 90 upwards, thereby raising the entire boom assembly 14 and the grinding assembly 16 mounted thereon. Once the desired height is reached, the bolts and nuts are refastened and the central member locked into place. Obviously, if a lower ceiling is encountered, the grinding assembly, boom and central member are lowered by reversing this process.

While one advantageous embodiment has been chosen to illustrate the invention, it will be understood by those skilled in the art that various changes and modifications can be made therein without departing from the scope of the invention as defined in the appended claims.

What is claimed is:

1. A ceiling grinding apparatus, the combination comprising:

a portable support assembly;

a central elongated member coupled to said support assembly for vertical movement;

a boom assembly pivotally mounted on the top of said central member;

a grinding assembly coupled to a first end of said boom assembly, said grinding assembly including blade means for grinding the ceiling and rotation means for rotating said blade means;

biasing means for biasing the second end of said boom assembly downwards and said first end upwards to force said blade means against the ceiling; and elevating means carried on said support assembly for moving said central member vertically upward and downward, said support assembly including first and second elongated structural members located in the same vertical plane and oriented at an angle of approximately 40° to each other.

third and fourth elongated structural members located in the same vertical plane and oriented at an angle of approximately 40° to each other, a horizontally oriented cross bar coupled at one end to said first and second structural members and at the other end to said third and fourth structural members, clamping means on said cross bar for releasably supporting said central elongated member in a vertical position, four wheels, each independently and rotatably coupled at the bottom of one of said elongated structural members, and a plurality of horizontally oriented struts interconnecting said elongated structural members, the lowermost thereof being at a height approximately equal to one-third the height of said structural members.

2. An apparatus according to claim 1, wherein said elevating means includes a winch, a cable carried by said winch, and means, coupled to said central member, for attaching an end of said cable to said elongated member.

3. An apparatus according to claim 1, and further including a collecting container coupled to said support assembly; and exhaust means for conducting the material grinded from the ceiling away from said blade means and into said collecting container.

4. An apparatus according to claim 3, wherein said exhaust means includes a housing coupled to said boom assembly and partially surrounding said blade means, said housing having an aperture therein, a conduit having one end communicating with the interior of said housing through said aperture and another end communicating with said collecting container, and a vacuum pump coupled to said conduit for drawing air and the material grinded from the ceiling into said collecting container.

5. An apparatus according to claim 1, wherein said rotation means includes a hydraulic motor.

6. An apparatus according to claim 5, wherein said central member is a closed tube and carries the hydraulic fluid for said hydraulic motor.

7. An apparatus according to claim 1, wherein said blade means comprises two elongated, straight blades pivotally mounted adjacent each other.

8. An apparatus according to claim 1, wherein said biasing means includes a spring coupled at one end to said boom assembly, an elongated chain coupled at one end to said support assembly, and hook means for coupling said spring and chain together to vary the biasing force between said support assembly and said boom assembly.

* * * * *